United States Patent [19]

Brink et al.

[11] 4,036,730

[45] July 19, 1977

[54] SOLVENT-REFINING OF COAL

[75] Inventors: Andries Brink, Sasolburg; Cornelis Kleynjan, Lochvaal; Quintin John Beukes, Sasolburg, all of South Africa

[73] Assignee: South African Coal, Oil & Gas Corporation Limited, South Africa

[21] Appl. No.: 579,145

[22] Filed: May 20, 1975

[30] Foreign Application Priority Data

May 24, 1974 South Africa ..... 74/3326

[51] Int. Cl.[2] ..... C10G 1/04

[52] U.S. Cl. ..... 208/8

[58] Field of Search ..... 208/8

[56] References Cited

U.S. PATENT DOCUMENTS

| | | | |
|---|---|---|---|
| 1,864,496 | 6/1932 | Pier et al. | 208/8 |
| 2,476,999 | 7/1949 | Orchin | 208/8 |
| 2,832,724 | 4/1958 | Doughty et al. | 208/8 |
| 2,913,388 | 11/1959 | Howell et al. | 208/8 |
| 3,341,447 | 9/1967 | Bull et al. | 208/8 |
| 3,503,864 | 3/1970 | Nelson | 208/8 |
| 3,645,885 | 2/1972 | Harris et al. | 208/8 |
| 3,663,420 | 5/1972 | Jacobs et al. | 208/8 |
| 3,692,662 | 9/1972 | Wilson et al. | 208/8 |
| 3,884,795 | 5/1975 | Wright et al. | 208/8 |

*Primary Examiner*—Delbert E. Gantz
*Assistant Examiner*—James W. Hellwege
*Attorney, Agent, or Firm*—Fred Wiviott

[57] ABSTRACT

A process is provided for the production of solvent refined coal, which comprises heating the coal while slurried in a solvent under hydrogenation conditions to substantially liquefy the coal followed by a step of separating the non-dissolved solids from the solution, e.g. by filtration, improved by the feature that a small percentage of the liquefiable matter of the coal is combined or recombined chemically with itself and/or existing insoluble matter so as to form larger particles which, e.g. acting as a filtering aid, assist in the separation of the solids from the liquid. These larger particles may be formed by hydrogen starvation during the heating of the slurry to the coal liquefying temperature or by controlled localized overheating prior to the liquefication step or by reducing the hydrogen partial pressure during the liquefication step to a value somewhat below a predetermined value for maximum extraction or by a posttreatment of the liquid product of the liquefication step at a temperature higher than the coal liquefication step. Two or more of these possibilities may be employed in combination.

30 Claims, No Drawings

SOLVENT-REFINING OF COAL

BACKGROUND OF THE INVENTION

The present invention relates to a process for the production of solvent-refined coal which comprises heating the coal whilst slurried in a solvent under hydrogenation conditions to substantially liquefy the coal, followed by a step of separating the non-dissolved solids from the solution which is formed as a result of said liquefying.

In the so-called solvent refining of coal, which process can be applied to moderately high rank through to low rank coals, the coal, in a particulate condition is subjected to liquefaction in a high-boiling solvent (e.g. boiling between 200° and 450° C), suitable as a hydrogen carrier (in a physical and/or chemical sense) at a temperature above 350° C, say between 350° and 500° C in the presence of hydrogen at a pressure of about 30 to 250 bar. After having been subjected to this treatment for about 15 for 120 minutes, more particularly 50 to 90 minutes, the pressure is let down from the reaction product and the liqueform reaction mixture is subjected to a step of solids separation, usually filtration, in order to remove therefrom all non-dissolved matter, namely the char-like solid such as fusain and the ash. The clear liquid phase is then subjected to distillation whereby the solvent is recovered and recycled, whereas the substantially non-volatile bottoms of the distillation constitute the so-called solvent refined coal (SRC) which can serve as a feed stock for catalytic hydro-cracking.

The solvent-refined coal can also be put to a number of other uses. It may be used as a fuel per se or in blends. In appropriate circumstances it can also be used as a feedstock for processing to fuels or petrochemicals and their precursors. Suitable forms of solvent-refined coal (also known as SRC) may be used as a constituent of coking coal blends or for the manufacture of carbon electrodes.

The step of separating the non-dissolved solids from the resulting solution, usually carried out by filtering, has in the past been a source of technical difficulties contributing to high production costs. Largely as a result thereof, the manufacture of SRC has up till now not been commercially attractive, and work on the production of SRC had been substantially confined to laboratory work and experiments on a smaller than normal production scale. The terms "SRC" or "solvent-refined coal", both in relation to the product and to the process of making such product, have acquired a distinct meaning in the art, which meaning is to be distinguished from different processes which are more correctly described as destructive hydrogenation or hydrogenative cracking and which result predominantly in liquid and/or gaseous products.

SUMMARY OF THE INVENTION

It is an object of the present invention to provide a process of the type defined above in which the step of separating the non-dissolved solids from the solution, is facilitated.

In accordance with the invention a process of the type defined above comprises the feature that a small percentage of the liquefiable matter of the coal is combined or recombined chemically with the formation of larger particles which, during said step of separating, assist in the separation of solids from liquids.

In other words, where the solids separation takes place by filtering, the invention aims at the conversion of part of the coal, by chemical reaction of a small fraction of the extractable matter into particles which act as a filtering aid. The results attainable indicate that the larger particles formed in the process, and which subsequently serve as a filtering aid, may also have a particularly favourable geometry for that purpose.

By "a small percentage" we mean in general that less than 5% preferably less than 3% of such matter which, under optimum extraction conditions would be extractable, is sacrificed to form, or contribute in the formation of, the said larger particles. This "sacrificed" extractable matter need not form the larger particles entirely by itself. It may act as a bonding agent to bond together particles of inherently insoluble and non-extractable matter.

The invention is thus based on a form of "controlled chemical sintering" by which particle growth is obtained in a desired manner to a desired extent, but at a very low cost in desired product. What takes place in many embodiments of the invention may also be described as a controlled form of "charring" with the formation of refractory coke particles.

In accordance with one preferred embodiment of the process, the coal slurry is heated up over a period to the temperature at which the major part of the hydrogenative solvent extraction takes place, and this heating up is carried out initially in the absence or substantial absence of added hydrogen to a temperature at which radical formation has already commenced in the extractable coal constituents, but is still low, whereafter hydrogen is introduced and heating of the coal slurry is continued, now in the presence of hydrogen, to a higher temperature at which the main step of solvent extraction with hydrogenation is carried out. The result of this procedure is an initial hydrogen starvation during the heating up period, whilst the rate of radical formation is still low and thereby encouraging the radicals which are formed to combine with one another in the form of larger particles. In the course of thus combining, it is possible for particles of non-extractable matter to be bonded together in a substantially reversible manner.

Preferably the slurry is thus heated up at a rate of between 2½ and 8° C/minute, more preferably 4° to 7° C/ minute, say 5° C/ minute i.e. over a period of about 80 minutes from about ambient temperature to the temperature at which the main hydrogenation and extraction takes place. The said hydrogen addition may take place preferably at a temperature of between 350° and 400° C, more preferably between 370° and 395° C, say at 380° to 390° C. The main step of extraction with hydrogenation normally takes place at a temperature at least 10° C higher than the aforesaid temperature of hydrogen addition, preferably at least 20° C higher, more particularly at between 400° and 500° C, preferably between 410° and 450° C, say at 420° C.

The aforesaid heating up at a controlled rate prior to the addition of hydrogen may be carried out batchwise, even if the next stage of the process, i.e. the extraction proper in the presence of hydrogen is carried out in a continuous manner.

In accordance with a further embodiment of the invention a controlled particle growth within the meaning of the invention may be attained by controlled localised overheating. This may be attained by maintaining localised high temperature zones where the rate of radical formation can exceed the rate of radical hydrogenation.

This localised controlled overheating effect may be assisted by the maintenance of comparatively quiescent conditions in the high temperature region. This may be achieved by a low degree of agitation, if any, at least in those regions and/or by avoiding high flow rates through those regions (avoidance of turbulence).

In accordance with yet another embodiment of the invention, the features of which, however, are preferably combined with the feature of localised controlled overheating, there is maintained, during said step of solvent extraction under conditions of hydrogenation, a partial pressure of hydrogen which is reduced below the predetermined value of hydrogen partial pressure of maximum extraction of coal by a predetermined value causing a small reduction in the percentage of extraction, say of up to about 3%, preferably not more than 1%. In appropriate cases this may, for example, be achieved is a system where the optimum working pressure for full extraction is between say 200 and 220 bar, by reducing the working pressure to say 110 to 150 bar. The exact value is best determined by routine experiment, because it will depend on the solvent used as well as on the type of coal.

In accordance with yet a further embodiment, the said larger particles are formed in that the liquiform product of the extraction in the presence of hydrogen is subjected to a step in postheating at a temperature higher than the temperature of said extraction, for example at between 440° and 550° C, preferably between 450° and 500° C, more preferably between 450° and 480° c, e.g. at 460° C.

The effect of the postheating may be assisted by maintaining conditions of hydrogen starvation, e.g. by carrying out this step at a pressure lower than the said extraction, letting off pressure resulting in a lowering of the hydrogen partial pressure. Such letting down pressure can be conducted in stages as the material travels from the extraction stage to the filtering stage.

The said postheating may be carried out in a tube furnace and is preferably conducted rapidly, over a short period of time of the order of minutes.

Turbulence or other conditions to counteract deposition on the tube walls may be maintained.

Preferably the features of two or more of the aforesaid embodiments are combined.

The favourable effects in accordance with the invention may inter alia be caused (as determinable by known modes of observation) by a shift of the particlesize distribution of the non-soluble residue into a higher particle size region.

In that case it may be found that the overall particle size distribution covers a broader range, and extends into a larger particle size region than before, and normally the particle size distribution curve becomes asymmetrical, the maximum being shifted into the larger particle size region. For example, under conventional operating conditions it will frequently be found that the particle size distribution curve is approximately symmetrical, forming a smooth broad arch between 0,5 and say 40 microns, having a broad top and having flanks of predominantly convex curvature. In the case of residue recovered from material subjected to the process in accordance with the invention, it may be found that the particle size distribution curve now covers the range 0,5 to 100 micron with a narrower maximum, say in the region of about 4 microns. However, in some embodiments it may also be observed that there is no, or a lesser degree of actual shift of the curve as a whole into the region of larger particles, but that the particle size distribution curve adopts a more favourable shape, such as a peak having predominantly concave flanks rising towards a comparatively narrow prominent maximum at an intermediate particle size, e.g. more or less in the middle of the particle size distribution curves. Combinations of these two favourable possibilities aforesaid may of course occur as well.

DESCRIPTION OF SPECIFIC EXAMPLES

In the following the invention will be further described by way of example. The examples are to be read and understood in the context of the aforegoing more general description of the invention for the purpose of applying the invention as exemplified to different operating parameters.

The experiments described below were all carried out in a 5 liter stirred batch autoclave. The usual procedure was to pressurise the cold autoclave to the desired pressure, before heating to the desired temperature, usually 420° C. No attempt was made to keep the reaction pressure constant by the addition of fresh hydrogen. At the end of the reaction period (usually 60–75 minutes) the contents of the autoclave were cooled to 275° C depressurised carefully and then filtered through a specially designed laboratory filter (precoat-type) at 275° C. The area of the filter was 50 $cm^2$ and the differential pressure 2.7 bar (40 psi). The filter medium consisted of a layer 12mm thick of diatomaceous earth, "Celite" (registered trade mark) grade 545, supported on fine wire gauze.

The rate of filtration could be accurately followed by collecting the cooled filtrate in a graduated receiver. The time taken to collect 850 ml filtrate under these standardised conditions was taken as the "Standard" filtration time.

The experimental results were obtained in batch autoclaves, but the conclusions are valid for continuous systems within reasonable limits as will be understood by those skilled in the art.

EXAMPLE 1

Hydrogen starvation during heating-up period

In this example hydrogen is withheld only during part of the heating-up period when the rate of radical formation is low. In this experiment the batch is heated in the autoclave from room temperature to the final temperature of 420° C over a period of 80 minutes, and the autoclave was then maintained at that temperature for a period of 75 minutes. The following results illustrate the benefits to be gained from such an approach.

| Exp. No. | Max. pressure bar | % Extraction DAF + basis | Filtration time, mins. | Hydrogen addition |
|---|---|---|---|---|
| 102 | 142 | 86,2 | 38 | from beginning |
| 105 | 152 | 86,3 | 17 | at 380° C |
| 106 | 152 | 85,7 | 13 | at 390° C |
| 113 | 152 | 79,1 | 5 | at 410° C |

+DAF = dry ash-free.

These results show, that the rate of filtration could be trebled by withholding hydrogen until the temperature had reached 390° C. When the hydrogen was added only when the temperature had reached 410° C, a further dramatic increase in filterability had taken place but at the expanse of depth of extraction.

These results were obtained in batch autoclaves but the principle could easily be applied in continuous plants where provision could be made for adding hydrogen at a suitable stage in the preheater. Such suitable stage will depend on the rate of heating employed and could be at the stage where the material has reached 390° C or a somewhat higher temperature.

EXAMPLE 2

Rate of heating

By increasing the rate of heating wall temperatures are increased. This results in the creation of localised high temperature zones where the rate of radical formation can exceed the rate of radical hydrogenation. Since this happens in a controlled way in the wall layer only, the way is opened for controlled sintering. The experiments detailed below offer evidence of the value of this approach. All five were carried out with Waterberg coal (25% ash) and heavy creosote as solvent in a 1:2 ratio at 420° C.

| Exp No. | Max pressure bar | % Extraction DAF basis | Filtration time mins | Rate of heating |
|---|---|---|---|---|
| 96 | 133 | 85,8 | 23 | slow |
| 97 | 134 | 85,2 | 20 | medium |
| 98 | 146 | 85,2 | 10 | rapid |
| 215 | 175 | 90,8 | 29 | very slow |
| 214 | 191 | 90,7 | 22 | fast |

In the first three experiments the $H_2$ partial pressure was low, hence the hydrogenation capacity of the system was low, and an increase in heating rate (rate of radical formation) brought about a remarkable increase in rate of filtration at a negligible drop in extent of extraction. In the last two experiments the hydrogenation capacity of the system was high and it was not so easy for the rate of radical formation to exceed the rate of radical hydrogenation; in this case an increase in heating rate resulted in a less pronounced increase in filterability, but the effect was nevertheless noticeable.

EXAMPLE 3

Degree of agitation

The same effect described above can also be achieved by changing the degree of agitation in the system. Under conditions of high turbulence the skin effect will be small and vice versa. The results listed below were obtained in an autoclave fitted with a magnetic stirrer with an up-and-down action. The stroke rate could be varied. Otherwise conditions were as described in Example 2.

| Exp No. | Stirrer speed strokes/min | Max pressure bar | % Extraction DAF basis | Filtration time, mins |
|---|---|---|---|---|
| 68B | 50 | 123 | 83,9 | 3 |
| 67 | 75 | 134 | 84,8 | 5 |
| 65 | 150 | 132 | 85,7 | 12 |

Again it has been shown that a dramatic increase in filterability can be achieved at very little sacrifice of extraction depth.

EXAMPLE 4

Hydrogen partial pressure

A drop in $H_2$ partial pressure can have a beneficial effect on the rate of filtration. Thus from Table I it can be seen that in the case of anthracene oil as solvent, a drop in total working pressure from 207 to 115 bar resulted in a negligible drop in the percentage extraction but the filter cake resistance was decreased by more than 30% (experiments 396 and 385). In the case of the heavy creosote cut (<365° C) a drop in pressure from 217 to 142 bar resulted in a drop in percentage extraction from 90.8 to 87.2 but at the same time the filter cake resistance was more than halved (experiments 402 and 370) experiment 387 exemplifies conditions under which yield losses are excessive.

TABLE I

FILTER CAKE RESISTANCE AND PERMEABILITY

| | | Extraction | | | Filtration | | | |
|---|---|---|---|---|---|---|---|---|
| | | Pressure, bar | | | – | μ | C* | – |
| Exp No | Solvent | Initial | Max | % Extraction | Filtration time, seconds | Viscosity at 100° C poise | Solids conc, g/cm³ | $\mu C_3$ X10⁻³ |
| 366 | Heavy creosote | 75 | 153 | 90,2 | 2400 | 0,075 | 0,139 | 230 |
| 396 | A 0** | 105 | 207 | 90,7 | 9000 | 0,11 | 0,137 | 597 |
| 385 | A 0 | 55 | 115 | 90,3 | 6060 | 0,11 | 0,136 | 405 |
| 387 | A 0 | 25 | 65 | 72 | 2880 | 0,21 | 0,201 | 68,2 |
| 374 | Heavy creosote | 55 | 113 | 82,4 | 216 | 0,058 | 0,152 | 24,5 |
| 370 | Heavy creosote < 365° C | 65 | 142 | 87,2 | 564 | 0,042 | 0,147 | 91,3 |
| 348 | A 0 < 350° C | 35 | 82 | 83,4 | 840 | 0,045 | 0,163 | 114,5 |
| 402 | Heavy creosote <365° C | 110 | 217 | 90,8 | 1140 | 0,040 | 0,138 | 206 |

*C was calculated from the percentage extraction and the ash content of the coal, allowance being made for material lost in the form of gas, water and light condensate.
**A 0 = Anthracene oil

EXAMPLE 5

Post-heating

The liquid reaction material resulting from the hydrogenative solvent extraction step is heated at a pressure of 150 bar (mostly due to hydrogen) in an autoclave to 460° C. Immediately on reaching that temperature, the autoclave is allowed to cool down. The total time for heating up and cooling down is about 30 minutes.

A second batch is treated as above, however, in the absence of hydrogen,

The results obtained are as follows:

| Test Material | Standard filtration time | % Extraction Dry ash-free basis |
|---|---|---|
| Without post-heating | 94 minutes | 93,1 |
| Post-treatment with hydrogen | 25 minutes | 92,7 |
| Post-treatment without hydrogen | 15 minutes | 84,7 |

Intermediate results will be attained by carrying out the post-heating treatment at a reduced partial pressure of hydrogen.

Obviously it is possible to carry out the post-heating treatment by a continuous procedure instead of batchwise the above table is illustrative of what in the light of all examples read together is to be considered an extreme case. In order to lower the standard filtration time from 94 minutes to 15 minutes, the extract yield is reduced from 93.1% to 84.7%. This reduction represents a percentage of 9.0% of the liquefiable matter of the coal.

What we claim is:

1. A process for the production of solvent-refined coal which comprises the steps of:

a. heating coal slurried in a solvent having hydrogen carrier characteristics in the presence of hydrogen at a partial pressure of several times atmospheric pressure to substantially liquefy the coal, b. during said heating step controlling the heating temperature and partial pressure of hydrogen to attain a rate of free radical formation, said rate being a function of temperature, which exceeds the rate of radical hydrogenation, said latter rate being a function of partial pressure of hydrogen, and continuing said control or a period of time sufficient to chemically combine a small percentage of the liquefiable matter of the coal with the resulting formation of larger nondissolved solid particles, and c. separating non-dissolved solids from the solution formed by said liquefying and control steps.

2. Process as claimed in claim 1 wherein said small percentage is less than 5% by weight of said liquefiable matter which, under optimum extraction conditions would be extractable.

3. Process as claimed in claim 1 wherein said small percentage is less than 3% by weight of said liquefiable matter which, under optimum extraction conditions would be extractable.

4. Process as claimed in claim 1 wherein the solids separation takes place by filtration.

5. Process as claimed in claim 2, wherein the coal, being in the form of a slurry, is heated gradually to the temperature at which the major part of hydrogenative solvent extraction resulting in said liquefying takes place, and this heating is carried out initially with less hydrogen than that required to prevent free radicals of the liquefiable matter from forming said larger particles to a temperature at which radical formation has already commenced in the extractable coal constituents, but is still low, whereafter additional hydrogen is introduced and heating of the coal slurry is continued, now in the presence of sufficient hydrogen for the maintenance of active hydrogenation conditions, to a higher temperature at which the main step of solvent extraction with hydrogenation is carried out.

6. Process as claimed in claim 5, wherein the slurry is thus heated up at a rate of between 2½° and 8° C per minute from about ambient temperature to the temperature at which the main hydrogenation and extraction takes place.

7. Process as claimed in claim 6 wherein the slurry is thus heated up at a rate of between 4° to 7° C per minute.

8. Process as claimed in claim 5 wherein the said hydrogen introduction takes place at a temperature of between 350° and 400° C.

9. Process as claimed in claim 8 wherein the said hydrogen introduction takes place at between 370° and 395° C.

10. Process as claimed in claim 5 wherein the main step of extraction with hydrogenation takes place at a temperature at least 10° C higher than the temperature at which hydrogen is introduced.

11. Process as claimed in claim 10 wherein the main step of extraction with hydrogenation takes place at a temperature at least 20° C higher than the temperature at which hydrogen is introduced.

12. Process as claimed in claim 5 wherein the main step of extraction with hydrogenation takes place at between 400° and 500° C.

13. Process as claimed in claim 12 wherein the main step of extraction with hydrogenation takes place at between 410° and 450° C.

14. Process as claimed in claim 1 wherein a controlled particle growth is attained by maintaining controlled localized high temperature zones where the rate of radical formation exceeds the rate of radical hydrogenation.

15. Process as claimed in claim 14 wherein the effect of localised high temperature zones is assisted by the maintenance of comparatively quiescent conditions in the high temperature region.

16. Process as claimed in claim 1 which comprises predetermining the value of hydrogen partial pressure during the maintenance of said hydrogenation conditions required for maximum extraction of coal and wherein there is maintained, during said step of heating in a solvent under hydrogenation conditions, a partial pressure of hydrogen which is reduced below the predetermined value of hydrogen partial pressure for maximum extraction of coal by a predetermined value causing a small reduction in the percentage of extraction.

17. Process as claimed in claim 16 wherein the value of the partial pressure of hydrogen is predetermined experimentally for said small reduction to be up to about 3% by weight.

18. Process as claimed in claim 17 wherein the value of the partial pressure of hydrogen is predetermined experimentally for said small reduction to be not more than 1% by weight.

19. Process as claimed in claim 16 wherein the optimum working pressure for full extraction is between 200 and 220 bar and wherein said small reduction in the percentage of extraction is attained by reducing the working pressure to 110 to 150 bar.

20. Process as claimed in claim 16 combined with the feature that a controlled particle growth is attained by controlled localised maintaining of high temperature zones, where the rate of radical formation exceeds the rate of radical hydrogenation.

21. A process of the SRC type for the production of socalled "solvent-refined coal" (SRC), which comprises heating coal whilst slurried in a solvent having hydrogen-carrier characteristics and in the presence of hydrogen at a partial pressure of several times atmospheric pressure under hydrogenation conditions to substantially liquefy the coal, followed by a step of separating non-dissolved solids from the solution which is formed as a result of said liquefying and comprising the feature that the liqueform product of said liquefying, prior to the step of separating non-dissolved solids is subjected to a step of postheating at a temperature higher than the temperature during said liquefying, the condition of temperature which determines the rate of free radical formation and the condition of hydrogen partial pressure which determines the rate of radical hydrogenation being controlled during said postheating so that the rate of free radical formation exceeds the rate of radical hydrogenation, so as to chemically combine or recombine constituents of the liquefied matter to result in an increase in particle size in the non-dissolved solids which facilitates the subsequent separation of solids from liquid.

22. Process as claimed in claim 21 wherein the postheating is carried out at between 440° and 550° C.

23. Process as claimed in claim 21 wherein the postheating is carried out at between 450° and 500° C.

24. Process as claimed in claim 21 wherein the postheating is carried out at between 450° and 480° C.

25. Process as claimed in claim 21, wherein the effect of the postheating is assisted by maintaining conditions of hydrogen starvation.

26. Process as claimed in claim 25, wherein hydrogen starvation is attained by letting off pressure resulting in a lowering of the hydrogen partial pressure.

27. Process as claimed in claim 21 wherein said postheating is carried out in a tube furnace.

28. Process as claimed in claim 21 wherein said postheating is conducted rapidly, over a short period of time of the order of minutes.

29. A process of the SRC type for the production of so-called solvent-refined coal (SRC), which comprises heating coal whilst slurried in a solvent having hydrogen-carrier characteristics and in the presence of hydrogen at a partial pressure of several times atmospheric pressure under hydrogenation conditions to substantially liquefy the coal, followed by a step of separating non-dissolved solids from the solution which is formed as a result of said liquefying and comprising the steps of a. determining for a given set of process parameters, selected for effectively liquefying the coal, the relative yields of liquefied matter and non-dissolved solids, b. employing essentially the parameters referred to under (a) above, to manufacture said SRC, subject to the modification that during a stage after the coal has been converted into a slurry and before said step of separating, the application of heat to the slurry is so controlled in relationship to any hydrogen partial pressure at that stage that a small percentage of the relative yield of liquefied matter as determined under (a) is consumed in thermal conversion reactions taking place in lieu of hydrogenation reactions and which cause an increase of particle sizes in the non-dissolved solids, whereby the step of separating is facilitated.

30. Process as claimed in claim 29, wherein step (b) is controlled for said yield of liquefied matter to be reduced by less than 5%.

* * * * *